United States Patent [19]

Marzocco

[11] 4,028,850

[45] June 14, 1977

[54] SLIDING-WING DOOR FOR VEHICLES

[75] Inventor: Alessandro Marzocco, Milan, Italy

[73] Assignee: Socimi Societa Costruzioni Industriali Milano S.p.A., Milan, Italy

[22] Filed: Oct. 16, 1975

[21] Appl. No.: 623,083

[30] Foreign Application Priority Data

May 7, 1975 Italy ..... 23115/75

[52] U.S. Cl. ..... 49/212
[51] Int. Cl.² ..... E05D 15/10
[58] Field of Search ..... 49/209, 215–225

[56] References Cited

UNITED STATES PATENTS

| | | | |
|---|---|---|---|
| 2,269,630 | 1/1942 | Marinello | 49/221 X |
| 2,445,131 | 7/1948 | Wartian | 49/212 X |
| 3,728,819 | 4/1973 | Goldbach et al. | 49/218 X |

*Primary Examiner*—Kenneth Downey
*Attorney, Agent, or Firm*—Karl W. Flocks

[57] ABSTRACT

A sliding door for vehicles is disclosed, the improvement consisting in that special ball bearings are inserted between the sliding component parts of the guide and/or between the sliding component parts of the linear ejectors which thrust the door open (or closed). With such an arrangement, the frictional forces are considerably reduced and the operation of the whole door assembly becomes smoother.

2 Claims, 4 Drawing Figures

10
29a
30a
31a
31b
33a
33b
34a
35a
36a
37a
38
38a
39a
39b
40a
41a
42a
43a
43b
45a
46a
47a
48a
48b
51
52
53a
54a
80
81
82
83
84
85
86
II
III
IV

SLIDING-WING DOOR FOR VEHICLES

Copending application Ser. No. 581.673 of the same Applicant now U.S. Pat. No. 3,994,094; has as its subject-matter a sliding-wing door for vehicles, especially for vehicles rolling on rails, of the kind which, when opened, is first shifted from its seat to the outside of the vehicle and then caused to slide along the vehicle sidewall. Each door panel is suspended to a component part of a telescopically extendable guide, another component part of which is connected to the vehicle body so as to permit a displacement relative thereto. Characteristically, according to U.S. Pat. No. 3,994,094 of the same Applicant said other component part of the telescopical guide is rigidly affixed to the movable parts of at least two linear ejectors which are mounted in a rigid supporting structure affixed to the vehicle body in correspondence with the ceiling of the door space.

This invention relates to improvements relative to the manufacture of the telescopical guide and the linear ejectors and also relative to the mounting of the supporting structure for the ejectors on the vehicle body.

In order to secure the satisfactory operation with an unhindered sliding movement and an operation without troubles of the door which is the subject-matter of U.S. Pat. No. 3,994,094 of the same Applicant it has proven to be extremely important to provide a special guiding and sliding arrangement for the movable component parts of the ejectors and the telescopical guide so as to prevent any misalignment and to reduce the frictional forces to a minimum.

Moreover, it has been found advisable to provide adjustment means adapted properly to correct the positioning of the door, both on the horizontal and the vertical planes with respect to the vehicle body.

Having the above objects in view, according to the present invention, it has been envisaged to insert between the mutually slidable members of both the telescopical guide and the linear ejectors, rolling members as formed by ball bearings mounted on pivots which are integral with either of the members which are matched for the sliding movement and guided by the respective outer rings in rectilinear pathways provided on the other member.

By so doing, inasmuch as the individual rolling members are integrally supported by either of the matching members and the distance between the rolling members being fixed beforehand by the distance between the centre lines of the supporting pivots, auxiliary spreading means, such as cages and the like, can be dispensed with and a stabler and more reliable guiding action is obtained for the relatively slidable members without any risk of jamming of the rolling members.

Advantageously, each rolling member can consist of two ball bearings which are mounted side by side on the same pivot.

The supporting structure of the linear ejectors which carry the telescopical guide and, with the intermediary thereof, the door, is fastened to the vehicle body by means of a system which comprises on one side an arm oscillable about a vertical axle integral with the vehicle body, said arm being loosely passed through the supporting structure and via a locking member screwed to its end keeps the supporting structure locked by means of a curved resting area against the vehicle body, while on the other side, spaced apart from said arm, there are provided a locking pitman with possibility of a limited displacement in all the directions and a spreader which can be adjusted with curved resting members inserted between the supporting structure and the vehicle body.

By means of such a system the entire door-supporting structure can not only easily and rapidly assembled and disassembled; but its position relative to the vehicle body can be adjusted both with simplicity and accuracy.

The improvements the subject of the present application will be more detailedly described in the following, reference being had to the accompanying drawings.

Figure 1:
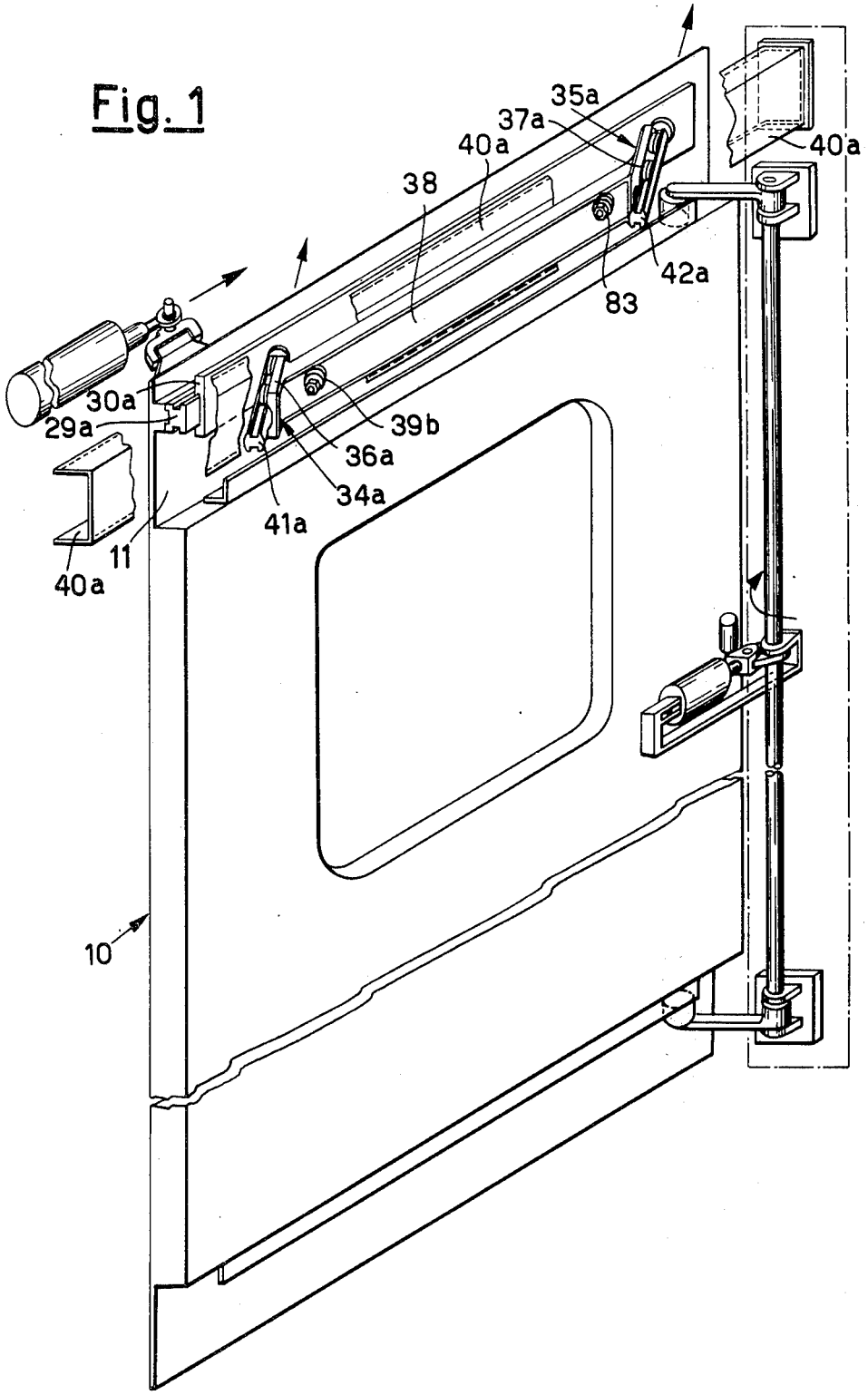
FIG. 1 is a diagrammatical perspective view from the interior of the vehicle of a door panel in the closed position according to copending application Ser. No. 581,673 of the same Applicant, which incorporates the improvements according to the present invention.

The door panel shown in FIG. 1 is identical to that according to U.S. Pat. No. 3,994,094 of the same Applicant, to which reference is made herein, so that there will be described hereinafter only those component parts which are of immediate interest for the improvements according to this invention.

The panel 10 carries in a top chamber 11 the sliding member 29*a* of the telescopical guide, the fixed member 30*a* has rear seats 51, 52: in these latter there are rigidly locked the ends of stems 41*a* and 42*a*, respectively, having a circular cross-sectional outline.

The fixed member 30*a* of the telescopical guide carries, both on its top and bottom a set of pivots 33*a*, 33*b*, rigidily affixed to said member and on the free ends of each of these pins there is mounted a double long-life ball bearing, the latter being shown generally at 31*a* and 31*b*, the outer rings of said double ball bearings being guided for sliding in rectilinear pathways as provided at the top and the bottom in a longitudinal direction on the member 29*a* of the telescopical guide.

With such an arrangement, there is a stable and reliable guiding of the member 29*a* with respect to the member 30*a*.

The distance between the centre lines of confronting couples of double ball bearings is decreased in correspondence with the end of the member 30*a* to which the entire stress is transferred when the panel 10 is completely pulled out (open) so that it is possible to keep within a comparatively narrow range the overlapping of the two members of the telescopical guide in the elongate condition. (see FIG. 2)

To the stems 41*a* and 42*a* there are coupled supporting members 36*a* and 37*a*, which, together with said stems make up linear ejectors, generally indicated at 34*a* and 35*a*, these supporting members being rigidly connected to one another by a supporting plate 38. The plate 38 is adjustably affixed, as will be better explained hereinafter, to a structure formed by a U-shaped strut, indicated at 40*a*, affixed in correspondence with its ends to the sides of the door space of the vehicle in the vicinity of the ceiling of said door space.

The two linear ejectors are identical so that the ensuing description refers only to the one shown at 34*a* and shown in detail in FIGS. from 2 to 4.

Figures 2, 3, 4:
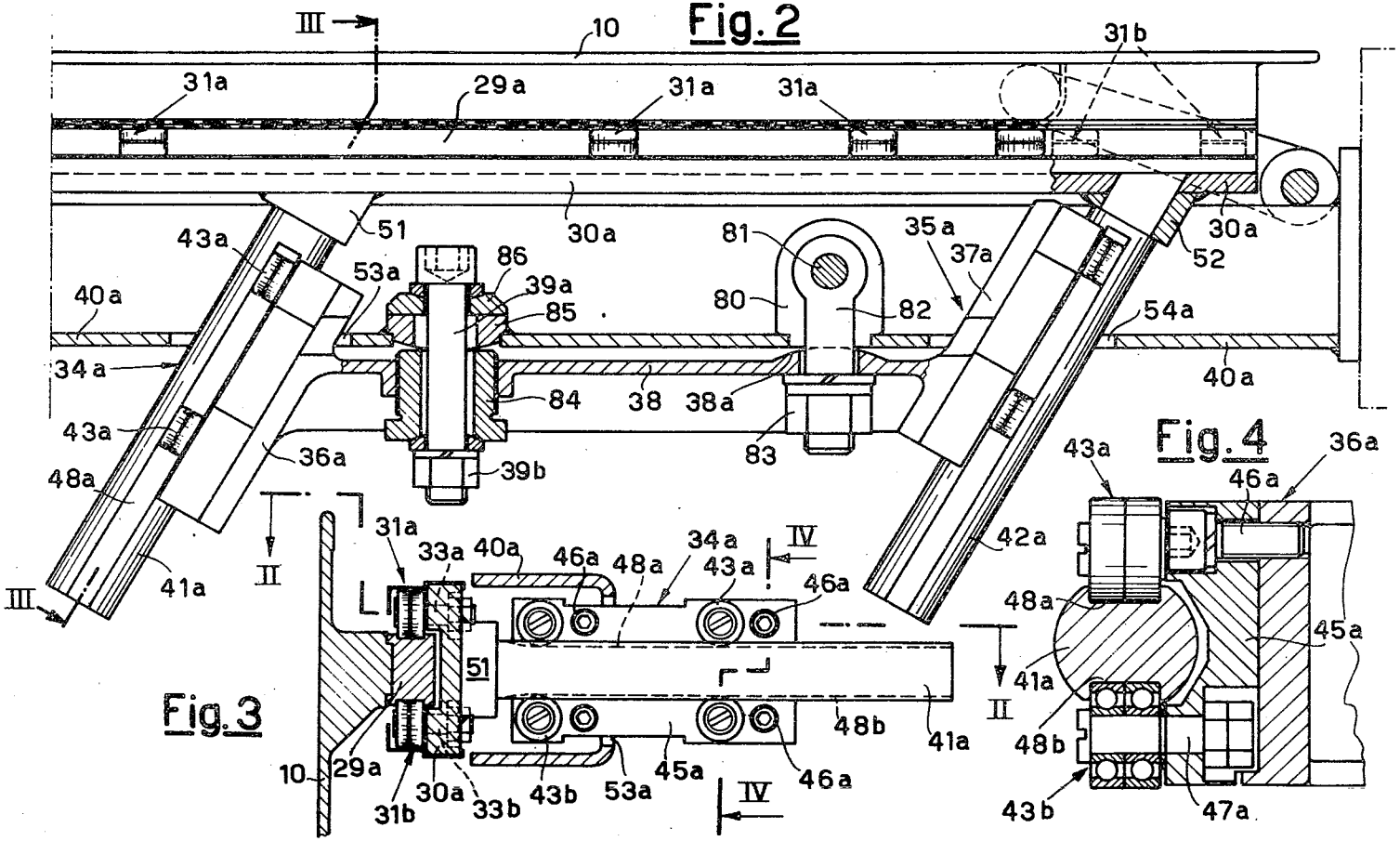
FIG. 2 is a horizontal cross-sectional view, taken along the segmental line II—II as shown in FIG. 3 and shows the suspension and sliding system according to this invention.
FIG. 3 is a vertical cross-sectional view taken along the segmental line III—III of FIG. 2.
FIG. 4 is a vertical cross-sectional view taken along the segmental line IV—IV of FIG. 3.

The supporting member 36*a* carries, affixed by bolts 46*a*, a plate 45*a* the longitudinal surface of which has a hollow for receiving and surrounding partially the stem 41*a* (see FIG. 4). To this plate there are affixed two pairs of pivots 47*a*, on each of which there is mounted a double ball bearing 43*a*, 43*b*.

The inner races of these bearings are guided in longitudinal rectilinear pathways 48*a*, 48*b*, provided at the top and the bottom of the stem 41*a*. By this arrangement a reliable guiding action is obtained with a minimum friction of the stem 41*a* with respect to the supporting member 36*a*.

The supports 36*a* and 37*a* with the relative coupled stems 41*a* and 42*a* are passed through specially provided slots 53*a*, 54*a* of the strut 40*a*, as shown in FIG. 2.

For the assemblage of the structural assembly comprising the supporting plate 38, the linear ejectors 34*a*, 35*a*, the telescopical guide 29*a*, 30*a* and the panel 10 relative to the fixed structure as composed by the strut 40*a*, the following means are provided.

To the strut 40*a* there is solidly affixed through brackets 80, a vertical pin 81 about which an arm 82 can oscillate, the arm being passed through specially provided slots of the strut 40*a* and of the supporting plate 38 and which carries, screwed to its end, a locking nut 83 which is adapted to lock the supporting plate 38 by the agency of a curved projection 38*a* against the strut 40*a* (see FIG. 2). The slots through the supporting plate 38 and the strut 40*a*, through which the arm 82 is passed, are wider than the arm, so that the arm is capable of taking a number of angular positions.

At a certain distance from the arm 82 there is a bolt 39*a* with its nut 39*b*, which is passed with a certain clearance, through a spreader 84, the latter being screwed to a flange integral with the supporting plate 38, an abutment member 85 affixed to the strut 40*a* and a member 86 which can be displaced on a surface of the abutment 85, the latter having a convex surface against which the spreader 84 rests. Between the head of the bolt 39*a* and the displaceable member 86, and between the nut 39*b* and the spreader 84 washers with spherical seat are inserted.

As can clearly be seen in FIG. 2, this locking system for the structure which supports the door panel on the fixed structure of the vehicle permits, by loosening the nuts 39*b* and 83, the adjustment of the position of the door panel with respect to the vehicle body in any direction. Such an adjustment can be carried out rapidly and accurately when the panel has already been mounted, to have it matching exactly the door space as provided on the vehicle.

The improvements according to the present invention have been described and illustrated as an exemplary embodiment but it is understood that their practical embodiments can be subjected to a number of changes without departing from the scope of the invention.

What is claimed is:

1. A sliding-wing door for vehicles, comprising at least one door panel suspended to a first member of a telescopic guide, a second member of which is carried by at least two liner ejectors having a slidable member fixed to said second member and a stationary member attached to a rigid structure affixed to the vehicle, rolling bearings being inserted between said members of the telescopical guide and between said members of each linear ejector, each bearing being mounted on a pin which is solid with one of said members and is slidingly coupled to and guided by a rectilinear pathway of the other member through said bearing, the stationary members of said linear ejectors being fixed to a supporting structure which is attached to said rigid structure by means of a swingable arm equipped with a clamping member and mounted on a vertical pin carried by said rigid structure and by means of a locking bolt spaced from said arm, the structures being equipped with passageways, with side clearance, for said arm and said bolt and with respective curved resting surfaces faced to said passageways, the resting surface for the locking bolt being adjustable by means of a spreading member which is screwed in the supporting structure and is axially passed through with side clearance by the locking bolt, the locking bolt being also arranged to axially pass with side clearance through an abutting member with curved surface engaged with said spreading member and through a further member which is displaceable along an opposite surface of said abutting member, the locking bolt having a head and an associated locking nut which rests on said displaceable member and said spreading member through respective washers having a spherical seat.

2. A door according to claim 1, characterized in that each pin carries a double bearing as formed by two bearings laid side by side.

* * * * *